United States Patent [19]

Bylo

[11] 3,934,532

[45] Jan. 27, 1976

[54] MARINE TRANSPORT

[76] Inventor: John J. Bylo, 7272 Willoughby Ave., Los Angeles, Calif. 90046

[22] Filed: Feb. 4, 1974

[21] Appl. No.: 439,375

Related U.S. Application Data

[63] Continuation-in-part of Ser. No. 187,537, Oct. 7, 1971, Pat. No. 3,793,974, which is a continuation-in-part of Ser. No. 794,938, Jan. 29, 1969, abandoned.

[52] U.S. Cl. ..... 114/72

[51] Int. Cl.[2] ..... B63B 25/00

[58] Field of Search..... 114/77 R, 77 A, 72, 43.5; 214/12, 14

[56] References Cited

UNITED STATES PATENTS 3,139,197 6/1964 Bylo ..... 214/12

FOREIGN PATENTS OR APPLICATIONS 1,022,374 3/1966 United Kingdom..... 114/72

*Primary Examiner*—George E. A. Halvosa
*Assistant Examiner*—Stuart M. Goldstein
*Attorney, Agent, or Firm*—Christie, Parker & Hale

[57] ABSTRACT

A marine transport system encompasses at least three ports. A plurality of modular hold units are releasably engageable with any one of a plurality of vessels and are so sized that, when loaded with cargo, each hold unit consumes a substantial fraction of the load-carrying capacity of any one of the vessels. A dock facility is located in each port for supporting a hold unit, independently of any of the vessels, so that cargo can be worked into and out of the hold unit through at least one side of the hold unit. The hold units are loaded into and removed from the docks by ballasting a vessel up or down into or out of load-transferring relation to a hold unit. Each vessel is arranged to operate normally only between two adjacent ports in the system. To move a hold unit between two non-adjacent ports, the hold unit is transferred by use of the corresponding dock facility, from vessel to vessel at each intermediate port so as to be passed from vessel to vessel.

1 Claim, 4 Drawing Figures

19
18
17
16
10
11
15
14
13
22
20
38
37
104
103
102
105
100
12
10
101
24
22
20
23

MARINE TRANSPORT

CROSS-REFERENCE TO RELATED APPLICATIONS

This application is a continuation-in-part of copending application Ser. No. 187,537 filed Oct. 7, 1971, which application was filed as a continuation-in-part of prior (now abandoned) application Ser. No. 794,938 of Jan. 29, 1969. This application describes the same subject matter as is described in one or both of its predecessor applications. U.S. Pat. No. 3,793,974 has been issued upon application Ser. No. 187,537.

FIELD OF THE INVENTION

This invention relates to marine transport systems and to procedures and structures in furtherance thereof. More particularly, the invention relates to a marine transport system in which modularization of cargo holds, docks, and transport vessels is maximized, the cargo holds preferably defining the entire cargo carrying capacity of a given vessel in the system and being interchangeable between vessels.

BACKGROUND OF THE INVENTION

THE STATE OF THE ART

At the present time, transport of cargo by water is, as a general rule, the most economical mode of transport available. In many instances, however, the cost differentials between sea and land transport, or between sea and air transport, in combination with the time differentials similarly involved, render land or air transport preferable to sea transport. If the cost of sea transport can be substantially reduced, the use of sea transport in preference to land or air transport would be increased to the advantage of the substantial maritime investment in the nation, as well as to the long term military advantage of the country.

The most significant single factor contributing to the total cost of transport of goods and materials by sea lies in cargo-handling expense. In break-bulk shipment of cargo by sea, wherein individual containers or small combinations or pallets of individual boxes, bags or other containers are loaded separately onto the transport vessel, manual handling of cargo occurs at many different points in the shipping process. In break-bulk shipment procedures, cargo is manually assembled and classified at a warehouse such as a manufacturers' warehouse or cartage broker's warehouse. Next the cargo is transferred to surface transport vehicles, another cargo handling operation, for transport to a transit shed located in the dock area. Upon arrival of the vehicle at the transit shed, the cargo is again handled as it is transferred from the vehicle to storage locations in the transit shed. Subsequently, the cargo is transferred from the transit shed to dockside; in this process, the cargo is handled both upon removal from the transit shed and upon deposit at dockside. Still later, the cargo is removed from dockside to the cargo hold of the ship by the use of the cargo handling gear located either at dockside or upon the vessel; this procedure involves two additional cargo handling operations. Upon deposit of the cargo within the vessel, it is frequently moved within the vessel by stevedores since the cargo handling gear of a conventional shelterdeck vessel, for example, does not provide access to all cargo stowage locations of the vessel. Upon arrival of the vessel at its destination, a reverse cargo handling procedure is involved. Therefore, it is seen that approximately sixteen separate cargo handling procedures are involved in the marine transport of cargo from original source to ultimate destination. Each cargo handling operation involves manual labor performed with or without the assistance of mechanized cargo handling devices. It is well known that labor cost, rather than equipment cost, is the single most expensive item in any process performed practically anywhere in the world at the present time, particularly so in the U.S.

In view of the above-described uneconomical characteristics of break-bulk cargo handling procedures, and in an effort to reduce the overall cost of marine transport, advances in the containerization of cargo have been realized in the U.S. as well as abroad. By these advances, the cargo handling process from manufacturer's warehouse to ship and from ship to destination warehouse has been simplified by the elimination of the transit shed. In this process, cargo is transferred directly from the manufacturer's warehouse, e.g., to dockside in a container which conventionally is the cargo van of a tractor-drawn cargo trailer (semi-truck trailer), the van being removable from its supporting wheels in the most advanced containerization operations presently in commercial use. These truck vans ultimately are loaded directly aboard the vessel, but in the interim between dispatch from the manufacturer's warehouse and loading aboard ship or barge, the vans must be assembled in a staging area adjacent to dockside from which they are later moved to the vessel. According to current containerization practices, cargo handling procedures involving manual labor occur fourteen times, as opposed to sixteen times with break-bulk cargos, in transport of a given item of cargo from manufacturer's warehouse or the like to destination warehouse. The basic practical advantage over break-bulk cargo handling techniques of containerization systems of the type described above is the reduction in the extent to which individual cargo packages are handled. That is, greater quantities of cargo are dealt with in each cargo handling operation with the result that handling costs per individual commercial unit of cargo are reduced to a greater extent that the reduction in the total number of cargo handling operations involved.

SUMMARY OF THE INVENTION

This invention provides a unique and highly efficient marine transport system which takes utmost advantage of the structures and methods described in my prior U.S. Pat. Nos. 2,371,149 and 3,139,197 and 3,349,742, if desired.

My prior U.S. Pat. Nos. 2,371,149 and 3,139,197 describe marine transport structures in which containerization of the cargo is maximized in that the vessel described in each of these patents features a cargo hold volume which is detachable as a unit from a self-propelled buoyant base which is basically the machinery and non-cargo-carrying aspect of a marine vessel. These prior patents teach that the cargo hold unit may be transferred to or received from a suitable dock structure, configured to cooperate with the hold unit, merely by ballasting the vessel per se into and out of mating engagement with the cargo hold unit. In practical effect, then, the cargo hold unit functions much like a movable transit shed or warehouse, reference in this respect being had to the foregoing description of conventional break-bulk cargo handling techniques; it will be understood, however, that the cargo hold unit does not comply with the technical definition of a transit shed as concerns aisle spaces and the like. Therefore, in a complete routing of cargo pursuant to the system contemplated herein, cargo is handled once to transfer cargo from a manufacturer's warehouse to a surface vehicle, a second time to transfer the cargo from the vehicle to the cargo hold unit, and twice again in the transfer of the cargo from the hold unit to a surface vehicle at the destination port and from the surface vehicle to the destination warehouse; in total, then, the present cargo handling system contemplates only four cargo handling operations in which manual effort is involved to any significant respect. In the system provided by this invention, handling costs attendant to transfer of a hold unit to or from the transit vessel involves minimum personnal and manual effort and is, therefore, insignificant in terms of contribution to the total cost of shipment of cargo by this system.

In addition to the foregoing direct cost saving advantages provided by this invention, additional advantages are obtained in that, by maximizing the volume of the container (the hold unit may be regarded as the ultimate container) to a degree far beyond that contemplated by existing containerization systems, the cost of the container per ton of cargo capacity is considerably lower than the corresponding cost associated with existing truck-type container modules. Further, inasmuch as the time involved in transferring the hold unit to a vessel like those described in the earlier two of my three above-mentioned patents is small, the vessel contemplated by this system is in productive motion from port to port for a considerably greater percentage of its useful life than is a container vessel of the type presently enjoying commercial exploitation.

The basic element or module of the present marine transport system is the ship-size container or cargo hold unit. The hold unit is standarized (i.e., modularized) in certain of its basic external dimensions and configurations, but its internal structure and remaining external features may be varied to accord with the specific requirements of particular commodities and cargo types. That is, while a cargo hold unit specifically tailored for use in shipping newsprint, for example, may appear externally to be essentially identical to a cargo hold unit tailored specifically for the transport of, say, bananas, internal cargo handling devices and environmental control facilities would be markedly different between these two basic containers. If desired, a cargo hold unit for use in a system of this invention may be constructed essentially as an automated warehouse for essentially automatic receipt and discharge of individual cargo units.

Further, the system contemplated by this invention permits variation in the design and outfitting of the vessels of the system to comply with the requirements of the ports between which they would normally operate, and also to conform to the particular sea-keeping criteria pertinent to the routes along which the particular vessels would normally be operated. In this regard, it is a feature of this invention that a given transit ship, especially where this invention serves commercial rather than military purposes, would run cyclically between two adjacent ports, say, from Los Angeles to San Francisco, Calif., and that a separate vessel would be operated on a shuttle route between San Francisco and Portland, Ore., for example. In essence, then, the system of this invention contemplates that individual transit vessels would merely cycle back and forth between adjacent ports on a particular shipping route, whereas the cargo hold units may be moved serially along a greater route from port to port, picking up or discharging cargo in each port as desired. Such usage of a given transit vessel between only two specified ports has significant and substantial benefits in terms of shipboard operating personnel; ship crews may spend most of their nights ashore rather than aboard ship, thereby permitting a simplification of the crew facilities aboard the transit vessel and providing a substantial net reduction in operating cost to the ship owner.

Further, the system of this invention contemplates the use of specially designed in-port vessels suited for receiving a cargo hold unit from a transit dock facility located in an outer harbor, for example, to a working dock facility located at the inner harbor, at which location cargo is actually worked, i.e., taken from or placed in the individual cargo hold unit. The in-port transit vessel may have propulsion machinery designed to produce a highly maneuverable, but rather low speed vessel, whereas the port-to-port transit vessels may be designed and equipped for maximum speed and sea-keeping ability, but only nominal maneuverability. The transfer dock facility which forms the interface between the port-to-port transit vessel and the in-port transfer vessel preferably is located at the outer harbor of a given port and is configured to permit economic usage thereof by both the transit vessel and the in-port vessel. The working dock facility at any given port need only be configured to mate with a particular in-port vessel and the standarized, molularly designed cargo units. In-port vessels and tranfer docks of the type contemplated above are described in my U.S. Pat. No. 3,793,974.

In the present system, therefore, it is seen that the cargo hold unit is the basic module involved, and that the transit vessels, in-port vessels, and the transfer dock and the working dock facilities are all cooperatively structured and arranged to cooperate with the cargo hold unit but may otherwise be varied in structure, proportions and arrangement to meet the peculiar limitations imposed by their own environment and specific use.

GENERAL RESUME OF CLAIMS

Generally speaking, in terms of a marine transport system, this invention includes, in combination with each other, a plurality of modular cargo hold units and plurality of self-propelled shuttle vessles. The system encompasses an overall route which is composed of a plurality of subroutes. The subroutes are substantially serially connected. Each subroute is defined to exist only between two adjacent ports in the system; the overall route of the system encompasses at least three ports, so there are at least two subroutes in the system. The number of shuttle vessels is large enough so that there is at least one shuttle vessel for each subroute. The shuttle vessels are provided for moving the hold units between the several ports of the system as desired.

The modular hold units are generally of uniform external configuration and dimensional arrangement over at least the lower portions thereof. The shuttle vessels are arranged to mate with any one, and at least one of the hold units and to support the hold units so engaged. The relative sizing between the hold units and the shuttle vessels is such that, when a loaded hold unit is mated to and supported by a shuttle vessel, the hold unit occupies a substantial portion of, if not all of, the load carrying capacity of the vessel. Each shuttle vessel includes a ballast system which can be operated to buoyantly raise and lower the vessel into and out of mating and load transferring relation to a hold unit which is supported above the vessel at a dock facility in the system.

A characteristic dock facility is provided in each port encompassed by the system, and the dock cooperates with the hold units and with the vessels of the system operating in that port. Each dock facility is arranged, in cooperation with the vessels of the system which operate in that port, for receiving and discharging hold units from and to the vessels and for supporting, in the absence of a vessel at the dock, the hold unit for the loading and unloading of cargo to and from the hold unit.

Each shuttle vessel is assigned to operate primarily on a specified subroute only between the two ports which are the opposite terminals of the subroute. Each shuttle vessel is arranged and equipped, in the areas of propulsive machinery, crew accommodations, hull form and proportion, and similar areas, with regard to and in consideration of the factors (such as navigational, meterorological and operational factors) which are pertinent to the particular subroute to which the vessel is primarily assigned. As a result, each of the vessels most likely is different from most or all of the other vessels in the system.

The result of the foregoing is that the hold units, if being moved between non-adjacent ports in the system, are shuttled bodily from first one to a second shuttle vessel, and so on, in each intermediate port through which the hold unit moves. The shuttling of the hold units from vessel to vessel is accomplished by use of the dock facilities in the interemediate ports.

DESCRIPTION OF THE DRAWINGS

The above-mentioned and other features of this invention are more fully set forth in the following detailed description of preferred embodiments of the invention, which description is presented with reference to the accompanying drawings, wherein.

DESCRIPTION OF THE ILLUSTRATED EMBODIMENTS

Figure 1:
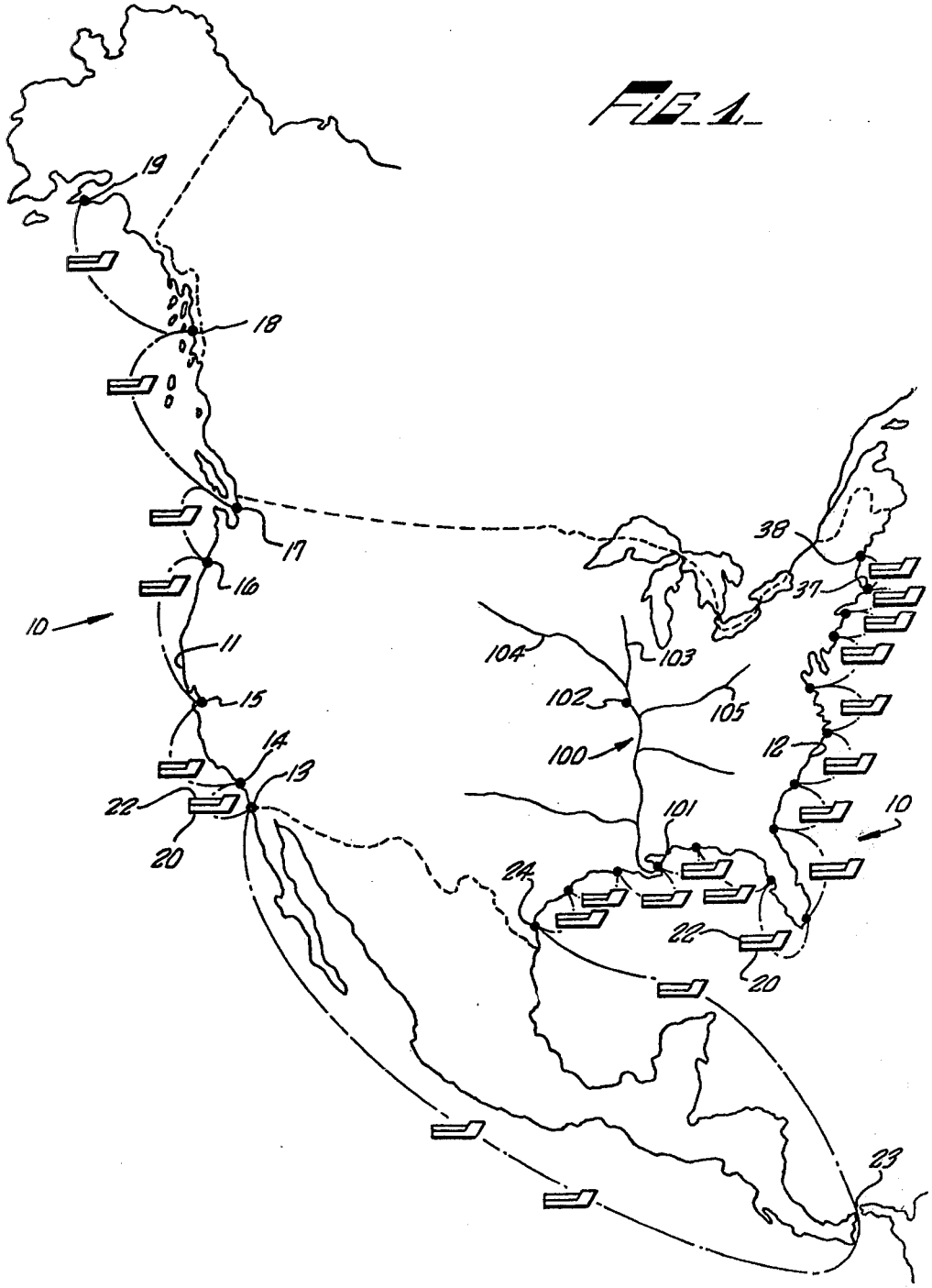
FIG. 1 illustrates, relative to the U.S., a commercial marine transport system according to this invention.

FIG. 1 illustrates the general functioning of a commercial marine transport system 10 serving the West Coast 11 and the East Coast 12 of the U.S. As will be made clear from the following description, this system is not restricted to service of coastal ports, nor is it restricted only to commercial service. The system also may service inland areas via rivers, and it may be combined with military transport systems operating according to similar principles as set forth in the following description. With reference to the West Coast of the U.S., reference numerals 13–19 designate, respectively, the following ports relative to which system 10 is described in detail:

| | |
|---|---|
| 13 | San Diego, California |
| 14 | Long Beach-Los Angeles, California |
| 15 | Greater San Francisco Bay Area, California |
| 16 | Astoria-Portland, Oregon |
| 17 | Seattle, Washington and Vancouver, B.C. |
| 18 | Juneau, Alaska |
| 19 | Seward-Anchorage, Alaska |

It will be understood that more or less ports on the West Coast of the U.S. may be included in system 10 as desired, the ports listed above having been identified merely for the purposes of example.

Figure 4:
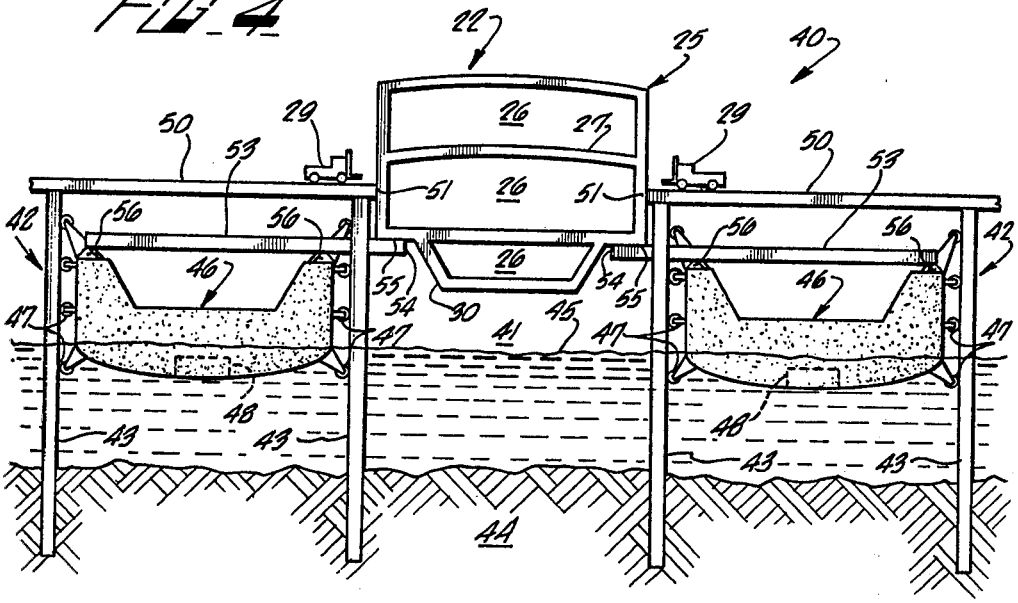
FIG. 4 is an elevation view of a working dock facility according to this invention.
Figure 3:
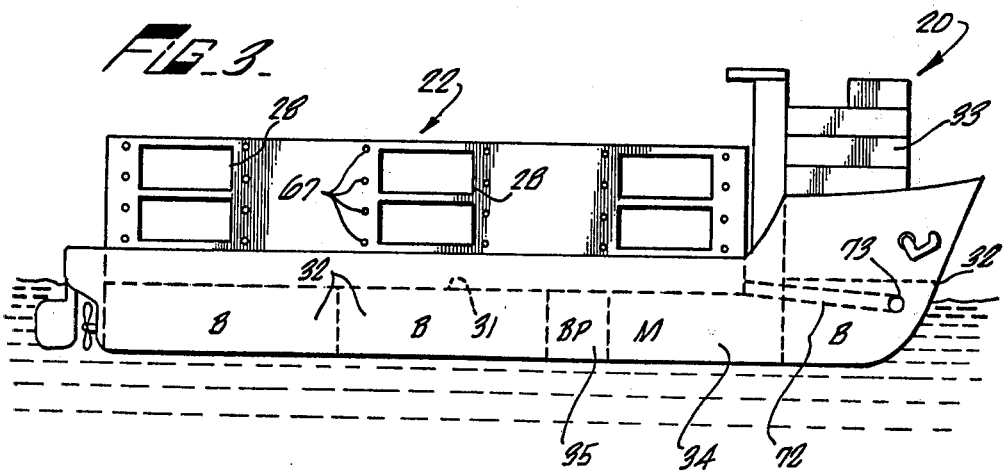
FIG. 3 is an elevation view of a port-to-port transit vessel for use in the system depicted in FIGS. 1 and 2.

As suggested above, system 10 includes a plurality of port-to-port transit vessels 20 (see FIG. 3) which cooperate with a greater plurality of modular, i.e., generally dimensionally and functionally standardized, cargo hold units 22 (see FIGS. 3 and 4). The system also includes, in each port comprehended by the system, at least one and preferably several working dock facilitites, a transfer dock facility, and an in-port transfer vessel. At least is many transit vessels 20 are provided as there are shipping runs between adjacent ports. Each run between adjacent ports in the system is a subroute of the overall route encompassed by the system. That is, FIG. 1 illustrates a transport system comprehending a total of twenty-two ports which correlate to twenty-one adjacent pairs of ports. Additional transit vessels may be required on shipping runs where cargo traffic is particularly heavy, or on runs where the distance between adjacent ports is large, as on the shipping run via Panama Canal 23 between San Diego 13 and Corpus Christi, Tex. 24.

Cargo hold units 22 of system 10 are all standardized as to selected external dimensions, arrangements and configuration. Each hold unit defines a structural shell 25 (see FIG. 4) which encloses a cargo space 26. The cargo space is horizontally subdivided by internal decks 27 within the shell, and closable access openings 28 (FIG. 3), sized to admit fork-lift trucks 29 or the like, are provided to the decks from the exterior of the shell. Because certain of their external features are standardized, the hold units are modular in design.

Each hold unit defines means which cooperate with a transit vessel to secure the hold unit in place on the transit vessel during ocean passage of the vessel. As shown in FIG. 4, such means includes a rib 30 which depends from the lower extent of the hold unit, and which cooperates in a correspondingly contoured recess 31 (FIG. 3) within the deck of the transit vessel which supports the hold unit when the hold unit and the vessel are mated. The interior of the rib defines a portion of cargo space 26.

The cargo hold units are made as large as possible. Preferably the hold units have capacity to receive at least 5000 tons of average density cargo. The transit vessels are sized to be large enough to receive and support at least one cargo hold unit (see FIG. 3), to provide sufficient ballast capacity 32 that the vessel may be buoyantly raised and lowered into and out of engagement with a loaded cargo hold unit as described below, to provide suitable accommodations 33 for operating personnel, and to provide space for propulsive machinery 34 and ballast pumps 35. It is preferred that the majority of the transit vessels present in system 10 be like vessel 20 (FIG. 3), namely, a carrier for a single hold unit which, when mated with the vessel, defines the entire cargo carrying capacity of the vessel. The cargo hold unit, therefore, will be seen to resemble a movable cargo warehouse.

It will be understood from the following text that this invention also comprehends, in the context of a commercial transport system, port-to-port transit vessels capable of receiving a plurality of modular cargo hold units 22. Such multi-unit transit vessels may be used to advantage in servicing the San Diego to Corpus Christi segment of system 10, or the Seattle to Juneau segment of the system where the distance between adjacent ports greatly exceeds the distance between adjacent pairs of ports elsewhere in the system.

Each transit vessel, consistent with the requirement that it be standardized to mate with the modular cargo hold units, preferably is adapted specifically to the particular subroute along which it operates in system 10. Thus, the transit vessel which operates between, say, Los Angeles 14 and San Francisco 15 may possess different propulsion and maneuvering equipment, hull form, and personnel accommodations than the transit vessel which operates between, say, Boston 37 and Portland, Maine 38 in view of the different average sea and weather conditions and the peculiarities, such as effective water depth, of the harbors serviced.

Figure 2:
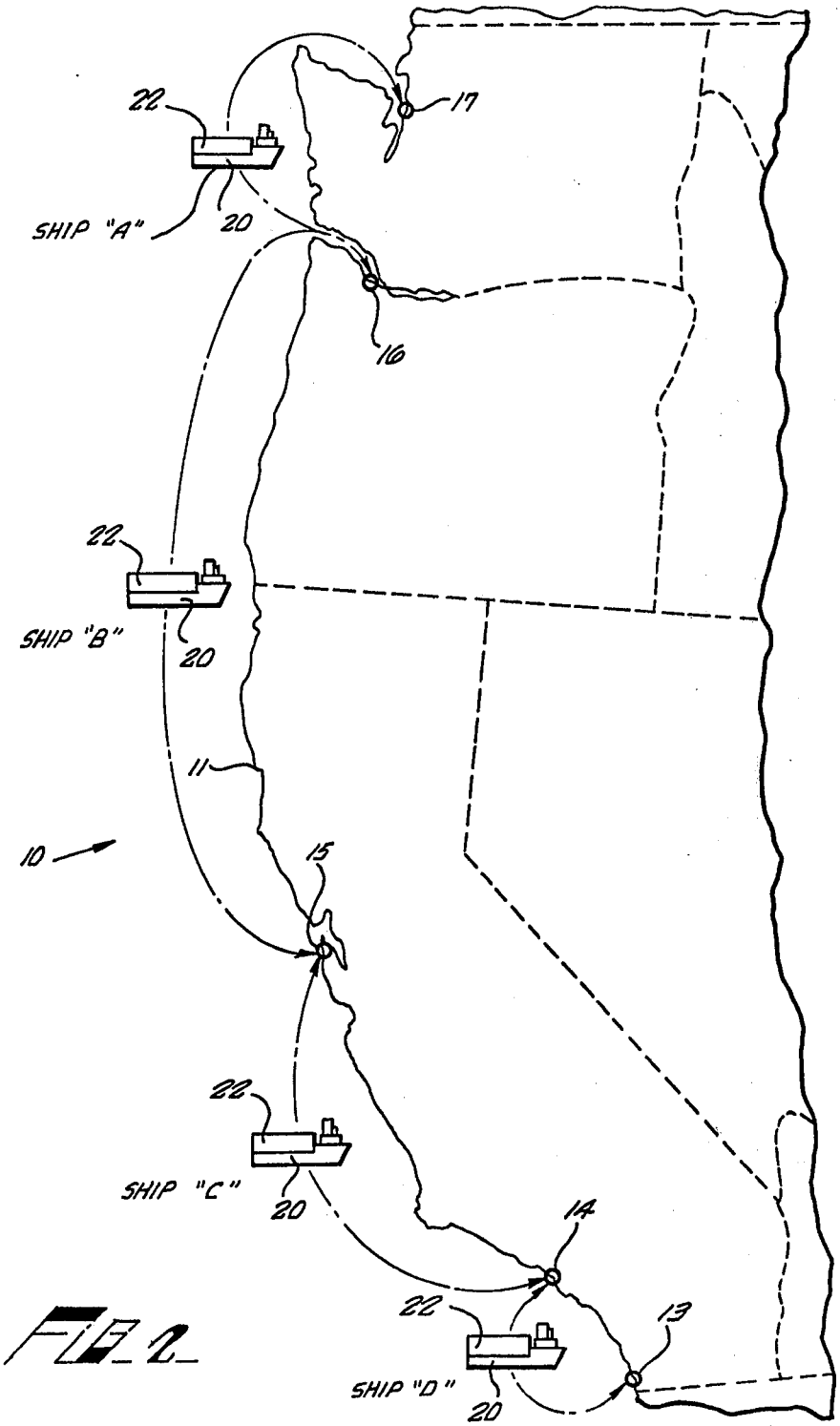
FIG. 2 is an enlarged illustration of the portion of FIG. 1 which pertains to the West Coast of the U.S.

Referring still to FIGS. 1 and 2, and also to FIG. 4, each port serviced by system 10 includes at least one working dock facility 40, and it is preferred that each port be equipped with a plurality of such dock facilities. Preferably, the working dock facilities are located in an inner harbor area where surface vehicles may have ready access to the dock facilities; a working dock facility may constitute a portion of a manufacturing operation located within the port area. The term "working dock facility" is used to describe a dock structure where cargo is worked (loaded or unloaded) relative to a cargo hold unit engaged with and supported by the dock structure.

Working dock 40, shown in FIG. 4, defines a vessel slip 41 between two parallel piling arrays 42. The pilings 43 in each array are all vertical and are driven into harbor bottom 44 to have their upper ends located well above water surface 45. The pilings of each array preferably are arranged in two rows of pilings disposed parallel to the length of slip 41, which rows in each array are spaced apart a distance greater than the width of a ballastable buoyant unit 46 located between the rows. Each buoyant unit carries a plurality of rollers 47 which cooperate with the opposed faces of the pilings in the two rows of the corresponding array for maintaining the buoyant unit in place between the pilings and for guiding the buoyant unit in vertical movement along the pilings. The buoyant units are caused to move vertically in the dock structure by operation of ballast pumps 48 located in each unit, which pumps are operable to cause water to be pumped into or out of the units. If desired, each buoyant unit 46 may be defined by a midship vessel bottom section according to the disclosures of my prior U.S. Pat. No. 3,349,742; such a practice enables maximum possible standardization of the structures used in system 10 and thereby results in minimum cost to install and operate the system.

Piling arrays 42 are spaced sufficiently far apart that slip 41 is wide enough to accommodate a vessel, possibly a port-to-port transit vessel 20 but preferably an in-port transfer vessel 49 described below, which carries a cargo hold unit 22. An access deck 50 is supported by the upper ends of the pilings in each array, and preferably both decks 50 of the dock structure are located in a common plane. The access decks are sufficiently strong that they can support fork-lift trucks 29 and such other vehicles and equipment as may be used to work cargo in a hold unit engaged with the dock structure. It is preferred that the opposing edges 51 of the access decks be spaced apart a distance which is only slightly greater than the width of cargo hold unit 22.

Each buoyant unit 46 carries means which are engageable with a cargo hold unit to support the hold unit above water surface 45 upon removal from slip 41 of the vessel which conveyed the hold unit to the working dock facility. As shown in FIG. 4, each buoyant unit 46 carries a plurality of retractable beams 53 which are disposed transversely of the length of slip 41. The beams are movably mounted to the upper extent of each buoyant unit for movement between (1) a retracted position in which the adjacent ends 54 of the beams are disposed outwardly of access deck edges 51 from the slip, and (2) an extended position in which (a) the beams extend in cantilever fashion inwardly of the slip and (b) ends 54 of opposing beams are spaced apart a distance less than the width of a cargo hold unit but greater than the maximum width of the depending rib 30 of a cargo hold unit. In their extended position, the beams are arranged for supporting a cargo hold unit by engagement with the downwardly open marginal flange-like surfaces 55 of the hold unit outwardly of and parallel to rib 30. Suitable bearings 56 are disposed between the beams and the buoyant units to movably support the beams on the buoyant units.

Pilings 43 need have only sufficient strength to support access decks 50 and to withstand whatever lateral loads may be imposed upon the pilings by the buoyant units. The basic function of the pilings is to support decks 50 and to guide buoyant units 46. The pilings do not support the weight of the cargo hold unit, this junction being served by the buoyant units.

It is preferred that the internal ballast spaces and the ballast machinery of buoyant units 46 be arranged so that the buoyant units may be controllably ballasted to impart desired conditions of trim (fore and aft inclination) and heel (transverse inclination) to the buoyant units. This capability is desired since this invention includes the provision of cargo hold units equipped with automatic or semi-automatic loading and unloading devices sensitive to gravity. That is, the cargo hold units may be fitted with gravity operated roller conveyors so that when the hold unit is tilted in one direction cargo is automatically induced to move within the hold unit toward access doors 28, and when tilted in the opposite direction cargo is moved in the hold unit away from the access doors, thereby to reduce the time and effort required to work cargo to or from the cargo hold unit.

System 10, the presently preferred commercial system-embodiment of this invention, also includes a transfer dock facility at least one of which is located in each port encompassed by the system; see my U.S. Pat. No. 3,793,974. It is preferred that the transfer dock facilities for each port be located in the outer harbor area of the port where the average water depth over the harbor bottom 44 is greater than in the inner harbor area. It is understood that an outer harbor area is within such breakwaters as may be associated with the particular port.

The purpose of each transfer dock facility is to receive a cargo hold unit from a port-to-port transit vessel and to discharge a received hold unit to an in-port transfer vessel (and vice versa), the transfer vessel being used to move the hold unit to a selected working dock facility in the port.

In view of the foregoing, it is apparent that transit vessels 20 operate as much as possible in shuttling cargo hold units between adjacent ports of system 10, thereby to serially advance the hold units from port to port in the system. The vessel is idle only those short intervals when it is either discharging or taking on a cargo hold unit in either of the ports between which it operates. As a result, the vessel is engaged in productive effort during substantially the entire length of its useful life; this fact is of extreme economic significance.

In view of the foregoing, the manner in which system 10 functions to permit efficient handling and shipment of cargo should be apparent. Thus, with reference to FIG. 2, ship A is a transit vessel operating between Seattle 17 and Portland, Oregon 16. Ship B is a similar transit vessel which operates between Portland and San Francisco 15. Inasmuch as the distance by water from Portland to San Francisco is greater than the distance between Portland and Seattle, and also because different weather conditions may be expected within these two different areas, the details of ship B may be different from the details of ship A to permit the particular ships to be tailored specifically to the requirements of their runs. Similarly, ships C and D operate between San Francisco and Los Angeles 14 and between Los Angeles and San Diego 13, respectively. In no case is any one ship in this portion of system 10 required, under normal circumstances, to operate on any run different from that illustrated in FIG. 2. Since there are more cargo hold units in use in the portion of system 10 shown in FIG. 2 then there are transit vessels, the hold units may be moved from port to port only as required, or only when all cargo in the port has been loaded, or according to an established schedule. At any given port, cargo may be loaded directly into the hold unit from the vehicle which has transported the cargo from a manufacturer's factory or the like to the harbor. Thus, handling of cargo between the source of manufacture and a hold unit is minimized, and even this degree of handling may be eliminated if the working dock facility constitutes a portion of the factory of the manufacturer.

It will be further understood that at least one cargo hold unit is available in a given port at a transfer dock facility at the time of arrival of the transit vessel in that port from the next adjacent port in the system. The particular cargo hold unit which must be so available is flexible in view of the large number of hold units which may be present in the port at that time; it is preferred that there be at least two cargo hold units in port at any given time, one of which is being loaded with cargo and the other of which is being unloaded. As cargo hold units are filled at the working docks, they are transferred to the transfer dock facility in the outer harbor and are replaced by another hold unit from the transfer dock facility. It is apparent, therefore, that stevedores may work regular eight hour days, instead of odd hours, with the result that overtime wages to stevedores may be minimized. Also, the transfer vessel in a given port is engaged in productive activity almost at all times. Deliveries of cargo to the port may be scheduled for normal working hours with the result that overtime wages for teamsters and the like also are minimized.

Thus, upon arrival at Seattle, say, of transit vessel A, the vessel would deposit the cargo hold unit it has brought from Portland and would pick up a cargo hold unit as to which the working of cargo has been completed. Ship A would spend minimum time in the Port of Seattle and maximum time in transit between Seattle and Portland. Upon arrival in Portland, transit vessel A would deposit the cargo hold unit it has brought from Seattle, collect a loaded cargo hold unit at the Portland transfer dock facility and depart for Seattle, all within minimum time. Also, at Portland the crew of ship A might be changed. In this latter regard, it is apparent that the crew of ship A may live in Portland and be gone from home only that time required to make one round trip from Portland to Seattle. This means that the home life of the individuals comprising the separate crews of ship A may be as normal as possible, with the result that wages paid to such crewment may be at a reasonable level and crew performance levels may be high.

When a southbound cargo hold unit, brought by vessel A to Portland from Seattle, has been loaded at Portland and returned to the transfer dock facility at Portland, such cargo hold unit is ready to be picked up by transit vessel B which operates between Portland and San Francisco. In this manner, a given cargo hold unit is moved from port to port through system 10 from transit vessel to transit vessel. The result is that cargo is transported efficiently via system 10 with minimum handling, minimum expense and minimum damage. Also, it is inherent in system 10 that cargo need not vacuumulate for long periods at dockside awaiting the arrival of a particular vessel in port. Rather, the cargo moves directly through the port to and from cargo hold units, thereby minimizing the congestion of surface traffic in the port.

In some instances, it may be desired to move a cargo hold unit from Seattle to Los Angeles, say, without working cargo to or from the unit at Portland and San Francisco. In such cases, the hold unit is not removed from the transfer dock facilities at Portland and San Francisco, but instead is picked up by vessels B and C at Portland and San Francisco, respectively, as soon as possible following arrival of vessels A and B at Portland and San Francisco, respectively. This mode of handling of a cargo hold unit may occur where all of the cargo loaded at Seattle is destined for Los Angeles, as might be the case with newsprint, for example, which might be manufactured in the vicinity of Seattle, but consumed in Los Angeles.

In commercial system 10, it is preferred that there be at least three working dock facilities in each port within the system so that, at each port, one cargo hold unit may be in a state of unloading cargo, and a second may be in a state of loading cargo. The third dock facility is open to receive the cargo hold unit which next arrives at the port from either port adjacent thereto in the system. As it is desired that there be at least two cargo hold units in any given port at any given time for maximum operating efficiency of the transport system, it is apparent that there are substantially more containers present in the system than there are ports.

This invention also permits economic and efficient transport of specialized cargos, such as fruits or newsprint and the like, by sea. In order that newsprint may be handled on highspeed offset printing presses, it is necessary that the newsprint have a specified water content. If the water content of the newsprint is too high, ink will not be transferred properly to the paper; if the water content is too low, the strength of the paper is diminished and the paper may tear during passage through the printing press. The maintenance of proper moisture levels in bulk newsprint has long been a costly problem both to newsprint manufacturers and to newsprint users.

This invention, however, comprehends the provision of cargo hold units which externally would be like all other cargo hold units used in the system, but which internally would be equipped to maintain a specified environment for a specific class of cargo. Thus, for newsprint, a cargo hold unit would be equipped with moisture and temperature control machinery. Newsprint loaded onto such a cargo hold unit at Seattle, say, would be the responsibility of the manufacturer and would have proper moisture content. During transit of the cargo hold unit from Seattle to Los Angeles, say, the relative humidity and temperature within the cargo hold unit would be controlled to maintain the newsprint moisture content at optimum levels. Since the hold unit could be sealed immediately upon completion of the loading process at Seattle, the manufacturer would be assured that the newsprint would reach Los Angeles in the proper condition. At Los Angeles, the hold unit may serve as a holding warehouse for newsprint prior to its actual use by customer newspaper, for example.

The same cargo hold unit used to transport newsprint from Seattle to Los Angeles might be used to transport citrus fruits from Los Angeles to Seattle. On the return trip to Seattle, the climate control equipment provided in the cargo hold unit would be adjusted to provide the relative humidity and temperature which is optimum for transport of citrus fruit.

It was mentioned above, in conjunction with a description of flooding duct 72 of transit vessel 20 shown in FIG. 3, that cargo hold units 22 preferably have watertight integrity at least over their lower extremity such that the hold units themselves may be floated. This feature of the hold units adapts them for use as barges. Such capability of a hold unit is particularly significant where transport system 10 is to serve not only the seaboard coasts of the U.S., but also the Mississippi river complex 100, for example (see FIG. 1). Accordingly, system 10 may include a transit vessel 20 for operation between New Orleans, Louisiana 101 and St. Louis, Missouri 102, for example. From St. Louis, cargo hold units may be moved in the upper Mississippi River 103 along the Missouri River 104 or the Ohio River 105, for example, by existing push-type river towboats exemplified by the vessels manufactured by Dravo Corporation. Such towboats may be used to maneuver either a single cargo hold unit or a raft of hold units lashed together in the same manner as river barge flotillas are assembled at the present time. Alternatively, cargo hold units may be moved from New Orleans to and from St. Louis by riverboats instead of by transit vessels, if desired.

The foregoing text contains a description of the use of an in-port transfer vessel for the purposes of shuttling cargo hold units between a transfer dock facility located in an outer harbor and a working dock facility located in an inner harbor. In the case of Astoria and Portland, Oregon, for example, the transfer dock facility may be located at Astoria and the working dock at Portland. the transfer vessel would shuttle the hold units between Portland and Astoria along the Columbia River. Transit vessels operating in system 10 in the vicinity of Portland would not be required to negotiate the river upstream of Astoria. This particular situation clearly illustrates the versatility of the commercial system heretofore described and the benefits which flow from use of such system.

In view of the foregoing description, it is apparent that marine transportation system 10 makes it possible for the cargo units described above to be treated in much the same manner that railroad flatcars, gondola cars, tank cars or box cars are processed. The economic advantage of a railroad is that the expensive locomotives and diesel engines used by the railroads are kept constantly in motion for the purposes of moving cargo units from place to place and are not tied up in an idle condition, like the conventional ship, while the cargo carrying units are being loaded or unloaded. This invention allows the expensive vessels 20, 49, 90, 125, 130 or 209, described above, to be kept in service for a maximum portion of their useful life in actually moving cargo from port to port, rather than sitting idle in the port as cargo is loaded into or out of the hold units. This invention also makes it possible for the hold units to be loaded or unloaded over extended periods during normal working hours.

It should also be apparent from the foregoing description that the ballastable units of a working dock may be operated separately or in cooperation with each other to adjust the position of a hold unit in the dock either in trim or heel as well as vertically relative to the dock structure.

It should be understood that the specific systems and operations described above have been set forth merely by way of example to illustrate the features and benefits provided by this invention. Specific structural arrangements have been set forth by way of example; each such arrangement may be varied to incorporate the features of other disclosed arrangements without departing from the scope of this invention. In short, then, the foregoing description of numerous examples and illustrative structures has been presented in furtherance of a comprehensive and complete description of the invention rather than for purposes of limitation of the invention.

What is claimed is:

1. A marine transport system comprising, in combination, a plurality of modular cargo hold units of generally uniform external configuration and dimension over at least the lower portions thereof, a plurality of self-propelled shuttle vessels for moving cargo hold units between a plurality of at least three ports in the system, the system encompassing a route composed of a plurality of substantially serially connected different subroutes each of which is defined between two adjacent ports in the system whereby the system includes at least one port common to two subroutes, each shuttle vessel being configured to mate with at least any one of the hold units and to support the same, each hold unit being sized relative to the shuttle vessels when loaded and mated with any one of the shuttle vessels to consume a substantial fraction of the load-carrying capacity of the shuttle vessel, each vessel including ballasting means for buoyantly raising and lowering the vessel into and out of mating and load transferring relation to a hold unit supported above the vessel at a dock facility in the system, each shuttle vessel being defined and equipped as to propulsive machinery, and crew accommodations, hull form and proportion, and similar features in consideration of the navigational, meteorological, and operational factors pertinent to a particular system subroute in the system to which the shuttle vessel is assigned and on which the vessel is primarily operated whereby each vessel is different from most or all of the other vessels in the system, and a dock facility in each port in the system, each dock facility being cooperatively configured and arranged in cooperation with the vessels assigned to the subroutes common to the port and with the cargo hold units for receiving from and discharging to a shuttle vessel a loaded cargo hold unit and for supporting a received hold unit for the loading and unloading of cargo to and from the hold unit in the absence of a vessel at the dock facility, whereby, in moving a hold unit from one port on one subroute in the system to a second non-adjacent port on another subroute in the system, the hold unit is movable bodily from shuttle vessel to shuttle vessel at each port in the system intermediate the one port and the second port via the dock facilities in the intermediate ports.

* * * * *